United States Patent [19]

Sroussi et al.

[11] 4,159,961

[45] Jul. 3, 1979

[54] DIELECTRIC AND NON-MAGNETIC CERAMIC FOR HIGH FREQUENCY APPLICATIONS

[75] Inventors: Roland Sroussi; Jean Nicolas; Jacques Claudon, all of Paris, France

[73] Assignee: Thomson-CSF, Paris, France

[21] Appl. No.: 738,842

[22] Filed: Nov. 4, 1976

[30] Foreign Application Priority Data

Nov. 7, 1975 [FR] France ..... 75 34161

[51] Int. Cl.[2] ..... H01B 3/00

[52] U.S. Cl. ..... 252/63.2; 106/73.3; 106/73.33; 106/73.4; 106/73.5; 423/326; 423/593; 423/594; 423/598; 423/600; 252/63.5

[58] Field of Search ..... 106/73.3, 73.33, 73.4, 106/73.5; 423/326, 593, 594, 598, 600; 252/519, 520, 63.2, 63.5

[56] References Cited

U.S. PATENT DOCUMENTS

| | | | |
|---|---|---|---|
| 2,128,289 | 8/1938 | Dubilier et al. | 106/73.3 |
| 2,862,891 | 12/1958 | Jonker et al. | 252/519 |
| 2,933,458 | 4/1960 | King et al. | 252/520 |
| 3,410,728 | 11/1968 | Fullman et al. | 252/520 |

OTHER PUBLICATIONS

Geller et al., "Importance of Intrasublattice Magnetic Interactions and of Substitutional Ion Type Behavior of Substituted Yttrium Iron Garnets," *The Bell System Technical Journal*, vol. XLIII, Mar. 1964, No. 2, pp. 565–567.

Geller et al., "Crystal Chemical and Magnetic Studies of Garnet Systems," *Journal of Physical Chem. Solids*, (1960), vol. 13, pp. 28–32.

*Primary Examiner*—L. Dewayne Rutledge
*Assistant Examiner*—John P. Sheehan
*Attorney, Agent, or Firm*—Oblon, Fisher, Spivak, McClelland & Maier

[57] ABSTRACT

Dielectrics without any residual magnetization, produced by the technique of ceramics sintered at high temperatures, usable in devices operating at very high frequencies, such as X band. They are obtained by sintering at lower temperatures than for known dielectrics suitable for those applications and correspond to two possible general formulae:

$$Y_{3-x-z}Ca_{x+z}Zr_xFe_{5-x-y-z}Al_yMe_zO_{12}$$

where:

Me=Ge, Si or Ti;

x is of the order of 2
$0 \leqq y \leqq 2$
$0 \leqq z \leqq 1$ and $(1+Y)Li_2O$; $2xZnO$; $(2x+4y)TiO_2$ with: $1-0.4x-0.6y=0$.

11 Claims, No Drawings

DIELECTRIC AND NON-MAGNETIC CERAMIC FOR HIGH FREQUENCY APPLICATIONS

This invention relates to inusulators suitable for use in devices operating at high frequencies. It is known that numerous devices of this type use solid insulators with good dielectric characteristics, reference being made in particular to polarised circulators comprising a polarisation correcting system, coaxial circulators, wide-band impedance transformers for transmission lines and substrates for lines of the microstrip type.

Known dielectrics, such as pure alumina or the titanates of magnesium and calcium are excellent insulators with very low losses at high frequency operation. However, they do have one disadvantage, namely that their production involves sintering at a very high temperature, i.e. above 1600° C. (1800° C. in the case of alumina). Other dielectrics, such as the garnet of yttrium, are excellent insulators but retain a high level of magnetism at ambient temperature which is troublesome for certain applications, especially at very high frequencies.

The invention obviates these disadvantages.

According to the invention, there is provided a dielectric and amagnetic ceramic suitable for high frequency applications, wherein its general chemical formulae is derived from that of polycrystalline ferrites by replacing at least the $Fe^{3+}$ ions in the octahedral site by non-magnetic ions of the following group:

Al, Ca, ge, Li, Ti, Zn, Zr and in particular a ceramic of the general formula:

$$Y_{3-x-z}\,Ca_{x+z}\,Zr_x\,Fe_{5-x-y-z}\,Al_y\,Me_z\,O_{12}$$

where:

Me = Ge, Si or Ti;

x is of the order of 2

$O \leqq y \leqq 2$ $O \leqq z \leqq 1$

According to a variant of the invention, there is provided a ceramic wherein its general formulae, derived from that of polycrystalline ferrites of the spinel type, is as follows:

$$(1+y)Li_2O;\ 5(1-0.4x-0.6y)\,Fe_2O_3;\ 2x\,ZnO;\ (2x+4y)\,TiO_2$$

with:

$$1-0.4x-0.6y=0.$$

These materials may be obtained by the processes normally used for the production of polycrystalline ferrites, comprising for example the following steps:

(a) mixing with distilled water or alcohol high-purity oxides or salts (more than 99.9% pure) in quantities corresponding to the formulae selected, taking into account the losses or additions of elements resulting from the following stages;

(b) initial grinding of said mixture for 24 hours in steel jars containing steel balls;

(c) drying in an oven followed by calcining in a furnace at approximately 1200° C. (800° C. for the variant);

(d) second grinding of the product obtained in aqueous or alcoholic medium under conditions identical with those of the initial grinding operation, but over a period greater than 12 to 24 hours, i.e. 36 to 48 hours;

(e) drying and screening the powder thus obtained;

(f) shaping either by pressing in a steel mould, which necessitates the incorporation of a binder (which has to be subsequently removed by heating to 600° C.), or by so-called "isostatic" pressing in a rubber mould;

g) sintering under oxygen at a temperature in the range from 1300° C. to 1490° C. over a period ranging from 6 hours to 16 hours.

By way of non-limiting example, the values set out in the following Table were selected for the parameters x, y and z:

TABLE 1

| Example No. | Element Me | x | y | z | Formula | Sintering temperature |
|---|---|---|---|---|---|---|
| 1 | Si | 2 | 2 | 1 | $Ca_3Zr_2Al_2Si\,O_{12}$ | 1470°-1490° C. |
| 2 | Si | 2 | 0 | 1 | $Ca_3Zr_2Fe_2Si\,O_{12}$ | 1430°-1470° C. |
| 3 | Ti | 2 | 2 | 1 | $Ca_3Zr_2Al_2Ti\,O_{12}$ | 1430°-1470° C. |
| 4 | Ti | 2 | 0 | 1 | $Ca_3Zr_2Fe_2Ti\,O_{12}$ | 1330°-1370° C. |
| 5 | —* | 2 | 0 | 0 | $Y\,Ca_2Fe_3Zr_2\,O_{12}$ | 1380°-1420° C. |
| 6 | Ge | 2 | 0 | 1 | $Ca_3Zr_2Fe_2Ge\,O_{12}$ | 1375°-1425° C. |
| 7 | —* | 2 | 1 | 0 | $Y\,Ca_2Zr_2Fe_2Al\,O_{12}$ | 1430°-1470° C. |

*no element Me in this dielectric.

For materials sintered at a temperature equal to the means of the temperatures indicated in Table 1, the following characteristics, set out in Table 2 hereafter, were measured by the usual methods:

$d_{th}$: theoretical density;

$d_p$: practical density, measured by displacement of a liquid (water);

P: porosity in %;

$\rho$: resistivity in ohms-cm; $tg\delta 10^4$: tangent of the loss angle multiplied by $10^4$ measured at 9 GHz;

$\epsilon'$: relative dielectric constant;

$\alpha$: mean temperature coefficient of the dielectric constant in millionths per °C. between −50° C. and +100° C., measured at 1 MHz.

TABLE 2

| Example No. | $d_{th}$ | $d_p$ | P | $\rho$ | $tg\delta 10_4$ | $\epsilon'$ | $\alpha$ |
|---|---|---|---|---|---|---|---|
| 1 | 3.942 | 3.902 | 1% | $7.10^{13}$ | 3.4 | 11.5 | +122 |
| 2 | 4.207 | 4.182 | 0.6% | $5.10^{13}$ | 2.9 | 13.5 | +90 |
| 3 | 3.972 | 3.863 | 2.7% | $4.10^{13}$ | 6.3 | 12.8 | +81 |
| 4 | 4.228 | 4.200 | 0.7% | $4.10^{13}$ | 2.7 | 15.6 | +75 |
| 5 | 4.613 | 4.585 | 0.6% | $7.10^{13}$ | 1.4 | 14.6 | +110 |
| 6 | 4.419 | 4.379 | 0.9% | $6.10^{13}$ | 1 | 13.2 | +85 |
| 7 | 4.511 | 4.483 | 0.6% | $4.10^{13}$ | 3.3 | 13.8 | +166 |

The magnetisation measurements at the temperature of liquid nitrogen (−196° C.) and at ambient temperature showed that the residual magnetism is extremely low and that, accordingly, the materials obtained are substantially amagnetic in the temperature range from −40° C. to +85° C.

It can be seen from Table 2 that the materials obtained are excellent insultors (resistivity greater than $10^{13}$ ohms-cm) for dielectrics with a high constant and a low temperature coefficient. Their losses at high frequency are extremely low by virtue of the absence of magnetisation and the smallness of the loss angle at 9 GHz. The very small difference between theoretical density and practical density shows that the materials have a very low degree of porosity. Accordingly, they are eminently suitable for use in the production of "hyperfrequency" devices which have to withstand severe climatic conditions.

One explanation for the performances observed is based on the theory of the octahedral and tetrahedral sites of the iron in polycrystalline ferrites. In cases where x = 2 in particular, the $Fe^{3+}$ ions of the octahedral site were completely replaced by non-magnetic ions.

In the variant of the invention, there is provided a lithium-based spinel-type ferrite comprising substitutions of zinc and titanium and corresponding to the general formula:

$$(1+y)\ Li_2O;\ 5(1\text{-}0.4x = 0.6y)\ Fe_2O_3;\ 2x\ ZnO;\ (2x+4y)\ TiO_2;$$

which, by virtue of the addition of very small quantities of $Bi_2O_3$ (1% by weight) and of a small quantity (of the order of 10% by weight at most) of $MnO_2$, may be sintered at a temperature below 1000° C.

According to the principle of the invention, expanded to complete elimination of the iron, 1 − 0.4x − 0.6y should be equal 0.

By way of non-limiting example, a dielectric of the following formula was obtained for x = 2 and y = 0.33:

$$Li_{0.67}\ Zn\ Ti_{1.33}\ O_4$$

and, by virtue of the previous addition of 2.8 $10^{-3}$ mole of bismuth oxide and 0.14 mole of manganese dioxide, can be sintered at a temperature in the range from 925° C. to 975° C.

For the finished material, the results are as follows:

| | | | |
|---|---|---|---|
| $d_{th} = 4.451$ | $d_p = 4.321$ | $P = 2.9\%$ | $\rho = 9.10^9$ |
| $tg\delta = 15.10^{-4}$ | $\epsilon' = 19$ | | |

In addition, the residual magnetisation of the material is negligible in the temperature range from −40° C. to +85° C.

What we claim is:

1. A dielectric and non-magnetic ceramic suitable for high frequency applications, which comprises:

a polycrystalline ferrite of the formula:

$$Y_{3-x-z}\ Ca_{x+z}\ Zr_x\ Fe_{5-x-y-z}\ Al_y\ Me_z\ O_{12}$$

wherein Me is Ge, Si or Ti, $O \leqq y \leqq 2$, $O \leqq z \leqq 1$ and x is 2, wherein $Fe^{+3}$ ions present in the octahedral sites of the parent ferrite are replaced by non-magnetic ions.

2. The ceramic of claim 1, wherein the element Me is silicon with x = 2; y = 2 and z = 1.

3. The ceramic of claim 1, wherein the element Me is silicon with x = 2; y = 0 and z = 1.

4. The ceramic of claim 1, wherein the element Me is titanium with x = 2; y = 12 and z = 1.

5. The ceramic of claim 1, wherein the element Me is titanium with x = 2; y = 0 and z = 1.

6. The ceramic of claim 1, wherein the element Me is germanium with x = 2; y = 0 and z = 1.

7. The ceramic of claim 1, wherein the element Me is absent (z = 0) and x = 2 and y = 1.

8. A dielectric and non-magnetic ceramic suitable for high frequency applications, which comprises:

a polycrystalline ferrite of the spinel type of the formula:

$$(1 + y)Li_2 0.2xZnO.(2x+4y)TiO_2.$$

9. The ceramic of claim 8, wherein said spinel has the formula:

$$Li_{0.67}\ Zn\ Ti_{1.33}\ O_4$$

and wherein said ceramic is produced by incorporating up to 10 wt.% $MnO_2$ and about 1 wt.% $Bi_2O_3$ in the mixture of starting materials.

10. A ceramic device which operates at high frequencies formed from the dielectric ceramic composition of claim 1.

11. A ceramic device which operates at high frequencies formed from the dielectric ceramic composition of claim 8.

* * * * *